United States Patent [19]

Abel et al.

[11] 4,441,885

[45] Apr. 10, 1984

[54] ANTICREASE FINISHING COMPOSITION AND USE THEREOF IN THE DYEING OR WHITENING OF TEXTILE MATERIAL WHICH CONTAINS POLYESTER FIBRES

[75] Inventors: Heinz Abel, Reinach; Paul Schäfer, Riehen, both of Switzerland

[73] Assignee: Ciba-Geigy Corporation, Ardsley, N.Y.

[21] Appl. No.: 370,761

[22] Filed: Apr. 22, 1982

[30] Foreign Application Priority Data

Apr. 29, 1981 [CH] Switzerland ..... 2781/81

[51] Int. Cl.[3] ..... D06P 1/642; D06P 1/613; D06P 1/16

[52] U.S. Cl. ..... 8/603; 8/491

[58] Field of Search ..... 8/582, 603

[56] References Cited

U.S. PATENT DOCUMENTS

| | | | |
|---|---|---|---|
| 3,114,588 | 12/1963 | Lewis | 8/603 |
| 3,513,493 | 5/1970 | Chantilly et al. | 8/587 |
| 3,531,238 | 9/1970 | Hendricks et al. | 8/586 |
| 3,819,327 | 6/1974 | Kuwayama et al. | 8/603 |
| 3,957,430 | 5/1976 | Hewitt et al. | 8/587 |
| 4,055,393 | 10/1977 | Schafer et al. | 8/582 |
| 4,072,465 | 2/1978 | Daeuble | 8/582 |

FOREIGN PATENT DOCUMENTS

| | | | |
|---|---|---|---|
| 1034782 | 7/1966 | United Kingdom | 252/174.15 |
| 1105595 | 3/1968 | United Kingdom . | |
| 1406803 | 9/1975 | United Kingdom . | |
| 2039543 | 8/1980 | United Kingdom | 8/582 |

*Primary Examiner*—Maria Parrish Tungol

*Attorney, Agent, or Firm*—Edward McC. Roberts

[57] ABSTRACT

The invention relates to a novel anticrease finishing composition which comprises at least (A) an O-cyanoethylated compound of the formula (1) $R(O—CH_2CH_2CN)_n$, wherein R is an n-valent aliphatic, cycloaliphatic or araliphatic radical, and n is 1 to 5, and (B) a carboxylated polypropylene oxide adduct, or salt thereof, which adduct is obtainable from (a) an aliphatic diol having an average molecular weight of at most 2600, (b) an aliphatic dicarboxylic acid, or anhydride thereof, containing 4 to 10 carbon atoms, (c) an adduct of propylene oxide and an at least trihydric aliphatic alcohol containing 3 to 10 carbon atoms, and (d) a fatty acid containing 8 to 22 carbon atoms, and optionally, (C) an aliphatic alcohol containing 5 to 18 carbon atoms, a siloxane-oxyalkylene copolymer, or a mixture thereof, and/or (D) a polar solvent.

The novel composition is used in dyeing or whitening textile material which contains polyester fibres.

19 Claims, No Drawings

ANTICREASE FINISHING COMPOSITION AND USE THEREOF IN THE DYEING OR WHITENING OF TEXTILE MATERIAL WHICH CONTAINS POLYESTER FIBRES

The present invention relates to novel anticrease finishing compositions and to the use thereof in the dyeing or whitening of textile material which contains polyester fibres.

Anticrease finishing agents which are already commercially available are hydrophobic, plasticiser-like substances. On account of their low HLB value, they have the property—if they do not actually foam themselves—of at least stabilising foam resulting from residual surfactants or dye dispersants. The HLB value stands for the hydrophilic/lipophilic balance in a molecule.

Carboxylated polypropylene oxide adducts which are employed as anticrease agents are known e.g. from German Offenlegungsschrift No. 30 00 370. These products do not themselves foam, but they stabilise the foam of dispersants so strongly that it is scarcely possible to use them for dyeing polyester fibres in certain jet dyeing machines, e.g. in a short liquor jet dyeing machine.

Surprisingly, there has now been found a novel, non-foaming composition which may be used as anticrease finishing agent in dyeing textile material which contains polyester fibres.

Accordingly, the present invention provides a novel dyeing assistant composition which comprises at least (A) an O-cyanoethylated compound of the formula $$R(O—CH_2CH_2CN)_n, \quad (1)$$

wherein R is an n-valent aliphatic, cycloaliphatic or araliphatic radical, and n is 1 to 5, preferably 1, and (B) a carboxylated polypropylene oxide adduct, or salt thereof, which is obtainable from (a) an aliphatic diol having an average molecular weight of at most 2600, (b) an aliphatic dicarboxylic acid, or anhydride thereof, containing 4 to 10 carbon atoms, (c) an adduct of propylene oxide and an at least trihydric aliphatic alcohol containing 3 to 10 carbon atoms, and (d) a fatty acid containing 8 to 22 carbon atoms.

In addition to components (A) and (B), the composition of the invention may also contain (C) an aliphatic alcohol containing 5 to 18 carbon atoms, a siloxane-oxyalkylene copolymer, or a mixture thereof, and/or (D) a polar solvent.

Components (A), (B), (C) and (D) may be in the form of individual compounds or mixtures. Preferred compositions comprise all components (A), (B), (C) and (D).

An aliphatic radical R is preferably the hydrocarbon radical of an unsaturated or preferably saturated aliphatic monoalcohol containing 3 to 24 carbon atoms. This hydrocarbon radical may be straight chain or branched. Examples of aliphatic saturated alcohols are: propanol, isopropanol, n-butanol, isobutanol, sec-butanol, tert-butanol, n-amyl alcohol, isoamyl alcohol, tert-amyl alcohol, neopentyl alcohol, hexanol, 2-methylpentanol, 2-ethyl-hexanol, trimethylhexanol, 5-methyl-heptan-3-ol, octan-2-ol, trimethyl nonyl alcohol, decanol, lauryl alcohol, myristyl alcohol, cetyl alcohol, heptadecyl alcohol, stearyl alcohol, arachidyl alcohol, behenyl alcohol or alfols. Some representatives of alfols are alfol (8–10), alfol (10–14) and alfol (16–18). Examples of unsaturated aliphatic alcohols are: allyl alcohol, butenol, dodecenyl alcohol, hexadecenyl alcohol or oleyl alcohol. The alcohol radicals may be present individually or as mixtures, and may be mono-, di- or triethoxylated.

An aliphatic radical R may also be derived from a polyhydric aliphatic alcohol which contains at least 2, preferably 2 to 5, hydroxyl groups and preferably 2 to 9 carbon atoms, e.g. from a alkylenediol having an alkylene radical of 2 to 6 carbon atoms, such as ethylene glycol, 1,3- or 1,2-propylene glycol or 1,5-pentanediol, as well as glycerol, trimethylolethane, trimethylolpropane, erythritol, pentaerythritol, mannitol or sorbitol. These polyhydric alcohols can also be etherified with 1 to 6 moles of ethylene oxide or propylene oxide or mixtures thereof.

An aliphatic radical R is preferably alkenyl or, most preferably, alkyl, each of 3 to 22 carbon atoms.

A cycloaliphatic radical R is preferably derived from cyclopentanol, cyclohexanol, cyclododecanol, p-nonylcyclohexanol or hydroabietyl alcohol, whereas an araliphatic radical is preferably derived from benzyl alcohol, phenylethyl alcohol or phenoxyethanol, and the benzene nucleus may also be substituted by lower alkyl, e.g. methyl, ethyl or isopropyl, or by lower alkoxy such as methoxy, ethoxy or isopropoxy, or by halogen.

Very suitable cyanoethylated compounds have the formula $$R_1—O—CH_2CH_2CN \quad (2)$$

wherein $R_1$ is an aliphatic radical of 3 to 22 carbon atoms or a phenoxyethyl radical which is unsubstituted or substituted by halogen, lower alkyl or lower alkoxy.

Lower alkyl and lower alkoxy in the definition of the radicals of the cyanoethylated compounds are usually those groups or group components which contain 1 to 5, preferably 1 to 3, carbon atoms, e.g. methyl, ethyl, n-propyl, isopropyl, n-butyl, sec-butyl or amyl, or methoxy, ethoxy or isopropoxy.

Halogen in connection with all substituents is e.g. fluorine, bromine or, preferably, chlorine.

Typical representatives of the cyanoethylated compounds employed in this invention are those of the formulae:

$$C_2H_5—OCH_2CH_2CN \quad (3)$$

$$C_4H_9O—CH_2CH_2CN \quad (4)$$

$$(CH_3)_2CH—CH_2O—CH_2CH_2CN \quad (5)$$

$$CH_3CH_2CH_2\underset{\underset{CH_3}{|}}{CH}—CH_2—O—CH_2CH_2CN \quad (6)$$

$$C_6H_{13}O—CH_2CH_2CN \quad (7)$$

$$C_6H_{13}—\underset{\underset{CH_3}{|}}{CH}—O—CH_2CH_2CN \quad (8)$$

$$C_8H_{17}O—CH_2CH_2CN \quad (9)$$

$$C_4H_9CH(C_2H_5)-CH_2O-CH_2CH_2CN$$

$$CH_3CH_2-CH(CH_3)CH_2CH(C_2H_5)-OCH_2CH_2CN \quad (11)$$

$$C_{12}H_{25}O-CH_2CH_2CN \quad (12)$$

$$(CH_3)_3C-CH_2O-CH_2CH_2CN \quad (13)$$

$$(CH_3)_3C-CH_2CH(CH_3)CH_2CH_2O-CH_2CH_2CN \quad (14)$$

$$R'-O-CH_2CH_2CN$$

wherein R'=alfol radical (8-10), (10-14), (12-14), (12-18) or (16-18)

$$C_{18}H_{37}O-CH_2CH_2CN \quad (16)$$

$$NC-CH_2-CH_2-O-CH_2CH_2-O-CH_2CH_2CN \quad (17)$$

$$NC-CH_2CH_2-O-CH_2CH_2-S-CH_2CH_2CN \quad (18)$$

$$\begin{array}{l} CH_2-O-(CH_2-CH(CH_3)-O)_2CH_2CH_2CN \\ | \\ CH-O-(CH_2-CH(CH_3)-O)_2CH_2CH_2CN \\ | \\ CH_2-O-(CH_2-CH(CH_3)-O)_2CH_2CH_2CN \end{array} \quad (19)$$

$$C\left[-CH_2-O-CH_2-CH(CH_3)O-CH_2CH_2CN\right]_4 \quad (20)$$

$$C\left[-CH_2-O-(CH_2-CH(CH_3)O)_2-CH_2CH_2CN\right]_4 \quad (21)$$

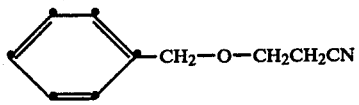

(22)

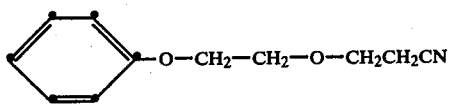

(23)

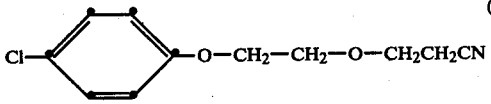

(24)

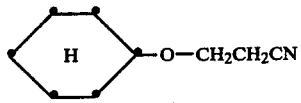

(25)

Among these representatives, especially preferred compounds are those of the formulae (8), (11), (12), (13), (14) and (23).

The compounds of the formulae (1) to (25) are prepared in a manner which is known per se. The preferred procedure is to react an alcohol of the formula R—OH, wherein R has the given meaning, with acrylonitrile. The reaction is conveniently carried out in an aqueous medium, e.g. in alcoholic medium, in the presence of an alkali metal hydroxide or alkali metal alcoholate or of a quaternary base such as trimethylbenzyl ammonium hydroxide, and in the temperature range from 10° to 60° C.

The polypropylene oxide adducts used as component (B) may be in the form of free acids or salts, e.g. alkali metal or ammonium salts. Representative alkali metal salts are, in particular, the sodium and potassium salts, and representative ammonium salts are ammonium, trimethylammonium, monoethanolammonium, diethanolammonium and triethanolammonium salts. The sodium or ammonium ($NH_4$) salts are preferred.

The carboxylated polypropylene oxide adduct is obtained preferably from 1 to 3 moles, preferably 1 mole, of component (a), 2 to 4 moles, preferably 2 moles, of component (b), 1 mole of component (c) and 0.5 to 2 moles, preferably 0.7 to 1 mole, of component (d).

Component (a) is preferably a diol of the formula $$HO-(CH_2-CH_2-O)_m \quad (26)$$

wherein m is 1 to 50, preferably 10 to 40. Examples of such diols are ethylene glycol, diethylene glycol or polyethylene glycols having an average molecular weight of 450 to 2300, preferably 650 to 1800. Further aliphatic diols may also be 1,3- or 1,2-propylene glycol or 1,5-pentanediol.

The aliphatic dicarboxylic acid employed as component (b) may be saturated or ethylenically unsaturated. Examples of suitable saturated dicarboxylic acids are succinic acid, glutaric acid, adipic acid, pimelic acid, suberic acid, azelaic acid or sebacic acid or their anhydrides, in particular succinic or glutaric anhydride.

Ethylenically unsaturated dicarboxylic acids are preferably fumaric acid, maleic acid or itaconic acid, and also mesaconic acid, citraconic acid and methylenemalonic acid. The preferred anhydride of these acids is maleic anhydride, which is also the preferred component (b).

Component (c) is, in particular, an adduct of propylene oxide and a trihydric to hexahydric alkanol containing 3 to 6 carbon atoms. This alkanol may be straight chain or branched. Typical examples of such alkanols are glycerol, trimethylolpropane, erythritol, pentaerythritol, mannitol or sorbitol.

The reaction product employed as component (c) may be prepared e.g. by addition of about 2 to 20 moles, preferably 4 to 12 moles, of propylene oxide to 1 mole of the trihydric to hexahydric alcohol. Adducts of 4 to 8 moles of propylene oxide and 1 mole of pentaerythritol have proved particularly suitable.

The fatty acid employed as component (d) may be an unsaturated or a saturated acid, e.g. caprylic acid, capric acid, lauric acid, myristic acid, palmitic acid, stearic acid, arachidic acid, coconut fatty ($C_{10}$-$C_{16}$) acid, behenic acid, decenoic acid, dodecenoic acid, tetradecenoic acid, hexadecenoic acid, oleic acid, linolenic acid, ricinolic acid, eicosenic acid, docosenic acid or clupanodonic acid. Preferred fatty acids are oleic acid, coconut fatty acid, tallow fatty acid, palmitic acid or, in particular, stearic acid.

Preferred polypropylene oxide adducts are obtained from the following components:

($a_1$) an aliphatic diol of the formula $$HO\text{-}(CH_2CH_2O)_{m_1}H, \quad (27)$$

wherein $m_1$ is 10 to 40, preferably a polyethylene glycol having an average molecular weight of 900 to 1800, preferably from 1500 to 1600, ($b_1$) a saturated or an ethylenically unsaturated aliphatic dicarboxylic acid, or anhydride thereof, containing 4 to 10 carbon atoms, preferably maleic anhydride, ($c_1$) an adduct of propylene oxide and a trihydric to hexahydric alkanol containing 3 to 6 carbon atoms, and ($d_1$) a saturated or unsaturated fatty acid of 12 to 22 carbon atoms, preferably coconut fatty acid, oleic acid, palmitic acid and, most preferably, stearic acid.

Typical representatives of these adducts are reaction products of:

1. 1 mole of the condensation product of 1 mole of pentaerythritol and 4 to 8 moles of propylene oxide, 2 moles of maleic anhydride, 1 mole of diethylene glycol and 1 mole of coconut fatty acid,
2. 1 mole of the condensation product of 1 mole of pentaerythritol and 4 to 8 moles of propylene oxide, 2 moles of maleic anhydride, 1 mole of polyethylene glycol having an average molecular weight of 1500 and 0.8 mole of stearic acid,
3. 1 mole of the condensation product of 1 mole of pentaerythritol and 4 to 8 moles of propylene oxide, 2 moles of glutaric or succinic anhydride, 1 mole of polyethylene glycol having an average molecular weight of 1500 and 1 mole of coconut fatty acid,
4. 1 mole of the condensation product of 1 mole of pentaerythritol and 4 to 8 moles of propylene oxide, 2 moles of maleic anhydride, 1 mole of polyethylene glycol having an average molecular weight of 900 and 1 mole of stearic acid,
5. 1 mole of the condensation product of 1 mole of pentaerythritol and 8 moles of propylene oxide, 2 moles of maleic anhydride, 1 mole of polyethylene glycol having an average molecular weight of 1500 and 0.7 mole of oleic acid or palmitic acid.

The adducts 1 to 5 may be in the form of free acids or salts, in particular sodium salts or ammonium salts.

The preparation of the polypropylene adducts is carried out by known methods. One process for the preparation of these products comprises reacting component (a) with components (b), (c) and (d) and, if desired, converting the reaction product into a salt. The reaction of component (a) with components (b), (c) and (d) may be conducted in the presence of an acid catalyst and/or of an organic solvent which is inert to the reactants, and in the temperature range from 80° to 150° C., preferably from 90° to 130° C. Sulfuric acid or p-toluenesulfonic acid may be used as catalyst. Examples of suitable organic solvents are benzene, toluene or xylene.

When a dicarboxylic acid is used as component (b), the different components may be reacted simultaneously. If component (b) is the anhydride of an aliphatic dicarboxylic acid, then the esterification is conveniently carried out stepwise. In a first step, the diol (component a)) is reacted in the presence of a polymerisation inhibitor, e.g. di-(tert-butyl)-p-cresol, with the anhyride by heating to 90°–130° C. to give the bismonoester of the dicarboxylic acid, which is then further esterified in a second step, with the addition of an acid catalyst and, if desired, in the presence of an inert organic solvent, e.g. benzene or toluene, with the adduct of component (c) and a fatty acid (component (d)), following which the ester product which still contains carboxyl groups may be converted into a salt by addition of a base, such as ammonia or an alkali metal hydroxide. Depending on their composition, the resultant adducts are solid to liquid, highly viscous products. They may therefore be in the form of waxes, pastes or oils, and are normally colourless or slighty yellow or brown in colour.

Preferred compositions comprise at least the following components:

(Aa) an O-cyanoethylated compound of the formula $$R_2\text{—}O\text{—}CH_2CH_2CN \quad (28)$$

wherein $R_2$ is an aliphatic radical of 6 to 22 carbon atoms or a phenoxyethyl radical which is unsubstituted or substituted by halogen, methyl or methoxy, and (Bb) a carboxylated polypropylene oxide adduct or salt thereof, which adduct has been prepared from the above components ($a_1$), ($b_1$), ($c_1$) and ($d_1$).

In addition to containing components (A) and (B), the novel composition may also contain, as component (C), an aliphatic alcohol containing 5 to 18 carbon atoms or a siloxane-oxyalkylene copolymer, or a mixture of such compounds. Component (C) acts in particular as foam inhibitor.

The alcohols may be used as individual compounds or in admixture with one another. They may be straight chain or branched, saturated or unsaturated, and they will normally be liquid at room temperature. Typical examples of such alcohols are: n-amyl alcohol, n-hexanol, trimethylhexanol, 2-ethyl-n-hexanol, octyl alcohol (octanol mixture of isomers), nonyl alcohol, decyl alcohol, lauryl alcohol, tridecyl alcohol, myristyl alcohol, cetyl alcohol, stearyl alcohol or oleyl alcohol, and also the alfols, e.g. alfol (6–10), alfol (8–10), alfol (10–14), alfol (12), alfol (16) and alfol (18). Preferred alcohols are alkanols of 5 to 10 carbon atoms, with 2-ethyl-n-hexanol being particularly preferred.

Further suitable optional components (C) are commercially available surface-active hydrophilic adducts of an organopolysiloxane and ethylene oxide and/or propylene oxide.

The organopolysiloxanes employed as starting materials for obtaining such adducts are, in principle, commercially available silicone oils which are described in German Auslegeschrift No. 20 31 827. Among these silicone oils, polydimethylsiloxanes are preferred. The siloxane-oxyalkylene copolymers suitable for use as optional component (C) may be obtained e.g. from halogen-substituted organopolysiloxanes, in particular polydimethylsiloxanes and alkali metal salts of polyoxyalkylene, e.g. polyethylene and/or propypropylene glycols.

These siloxane-oxyalkylene copolymers are polyether siloxanes which advantageously have a cloud point in the range from about 20°–70° C., preferably from 25°–50° C. The glycol content consisting of oxyethylene groups or oxyethylene and oxypropylene groups is advantageously from 35 to 85% by weight, preferably from 40 to 75% by weight, based on the total weight of the polyether siloxane.

A preferred embodiment of component (C) is accordingly a block polymer of a polydimethyl siloxane and ethylene oxide, or of a copolymer of ethylene oxide and propylene oxide, which block polymer has a cloud point of 20°–70° C., preferably from 25°–50° C. Such block polymers or polyether siloxanes may be illustrated by the probable formula

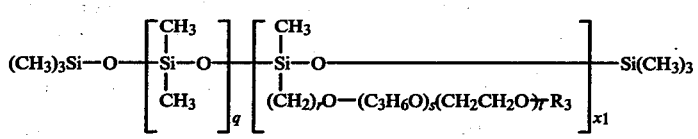

(29)

wherein q is 3 to 50, preferably 3 to 25, r is 2 or 3, s is 0 to 15, t is 1 to 25, $x_1$ is 3 to 10 and $R_3$ is alkyl of 1 to 4 carbon atoms, preferably methyl. Such polyether siloxanes are described e.g. in German Auslegeschrift No. 1 719 328 and in U.S. Pat. Nos. 2,834,748, 3,389,160 and 3,505,377.

Further polyether siloxanes which may be used as component (C) have the probable formula

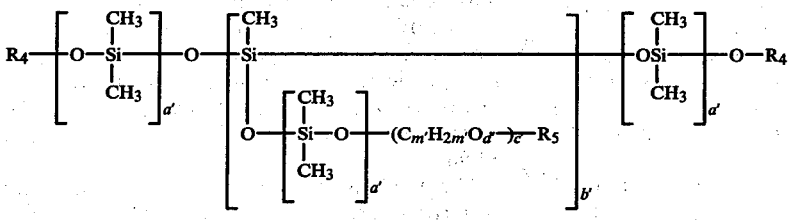

(30)

wherein each of $R_4$ and $R_5$ is alkyl of 1 to 4 carbon atoms, preferably methyl, a' is 1 to 20, b' is 2 to 20, c' is 2 to 50, d' is 1 or 2, preferably 1, and m' is 2 to 5, and the groups $C_{m'}H_{2m'}O_{d'}$ are preferably ethylene oxide groups or mixtures of ethylene oxide groups and propylene oxide groups. Such siloxane compounds are described in German Auslegeschrift No. 1 795 557.

A suitable component (C) which corresponds to the probable formula (29) and has a cloud point of 32° C., is e.g. SILICONSURFACTANT L 546® (registered trademark of Union Carbide). This silicone compound is used preferably in conjunction with 2-ethyl-hexanol.

In addition, the assistants of this invention may contain, as polar solvent (D), a water-miscible organic solvent. The addition of solvent improves the solubility of the composition. Examples of water-miscible organic solvents are aliphatic $C_1$–$C_4$alcohols such as methanol, ethanol, the propanols or isobutanol; alkylene glycols such as ethylene glycol or propylene glycol; monoalkyl ethers of glycols such as ethylene glycol monomethyl, monoethyl or monobutyl ether, and diethylene glycol monomethyl or monoethyl ether; ketones such as acetone, methyl ethyl ketone, cyclohexanone or diacetone alcohol; ethers and acetals such as diisopropyl ether, diphenyl oxide, dioxane, tetrahydrofurane, and also tetrahydrofurfuryl alcohol, pyridine, acetonitrile, γ-butyrolactone, N-methylpyrrolidone, N,N-dimethyl formamide, N,N-dimethyl acetamide, tetramethyl urea, tetramethylene sulfone etc. Mixtures of these solvents may also be used. The preferred solvent is water.

The compositions of this invention advantageously contain 10 to 60% by weight of component (A),
20 to 50% by weight of component (B),
0 to 15% by weight, preferably 1 to 10% by weight, of component (C), and
0 to 60% by weight, preferably 10 to 45% by weight, of component (D), in each case based on the weight of the total mixture.

The novel compositions may be prepared by simple stirring of components (A), (B) and optionally (C) and/or (D), to produce homogeneous clear formulations which are stable at room temperature.

The novel formulations are used in particular as anti-crease finishing agents in dyeing linear polyester fibres or blends of polyester fibres and cotton or wool. They increase the rate of diffusion of the dyes in the fibres and thereby increase the dye yield. Moreover, they have a foam inhibiting effect.

Accordingly, the present invention also provides a process for dyeing textile material which contains polyester fibres with disperse dyes, or for whitening such material with fluorescent whitening agents, which process comprises dyeing or whitening said material in the presence of the composition of the invention.

The amount in which the composition of the invention is added to the dyebaths or whitening liquors varies from 0.5 to 10% by weight, preferably from 2 to 8% by weight, based on the weight of the material to be dyed.

Suitable polyester fibre material which can be dyed or whitened in the presence of the novel composition is e.g. material made from cellulose esters, such as cellulose 2½-acetate and cellulose triacetate fibres, and especially linear polyester fibres.

Linear polyester fibres are to be construed as meaning synthetic fibres which are obtained e.g. by condensation of terephthalic acid with ethylene glycol or of isophthalic acid or terephthalic acid with 1,4-bis-(hydroxymethyl)cyclohexane, as well as copolymers of terephthalic acid and isophthalic acid and ethylene glycol. The linear polyester used up to now almost exclusively in the textile industry is that derived from terephthalic acid and ethylene glycol.

The fibre material can also be employed as blends with another or with other fibres, e.g. blends of polyacrylonitrile/polyester, polyamide/polyester, polyester/cotton, polyester/viscose and polyester/wool.

The textile material to be dyed or whitened can be in different states of processing, preferably piece goods, such as knits or wovens.

The disperse dyes to be used, which are soluble in water to only a very limited degree and are present in the dye liquor for the most part in the form of a fine dispersion, may belong to the most diverse dyestuff classes, for example to the acridone, azo, anthraquinone, coumarin, methine, perinone, naphthoquinone-imine, quinophthalone, styryl or nitro dyes. Mixtures of disperse dyes may also be used in the process of the invention.

In the process of this invention, polyester/wool blends are preferably dyed with commercially available mixtures of anionic dyes and disperse dyes.

The anionic dyes are e.g. salts of heavy metal-containing dyes or preferably of metal-free mono-, dis- or polyazo dyes including formazane dyes, as well as anthraquinone, xanthene, nitro, triphenylmethane, naphthoquinone-imine and phthalocyanine dyes. The anionic character of these dyes can be imparted by metal complexing alone and/or preferably by acid salt-forming substituents such as carboxylic acid groups, sulfuric acid ester and phosphoric acid ester groups, phosphonic acid groups or sulfonic acid groups. These dyes can also contain in the molecule reactive groups which form a covalent bond with wool.

Particularly interesting dyes are 1:1 or 1:2 metal complex dyes. The 1:1 metal complex dyes preferably contain one or two sulfonic acid groups. As metal they contain a heavy metal atom, e.g. a copper, nickel or especially chromium atom.

The 1:2 metal complex dyes contain, as central metal atom, a heavy metal atom, e.g. a cobalt or especially a chromium atom. Attached to the central atom are two complexing components, at least one, but preferably each, of which is a dye molecule. In addition, both dye molecules participating in the complexing can be identical or different. The 1:2 metal complex dyes can contain e.g. two azomethine molecules, a disazo and a monoazo dye molecule or preferably two monoazo dye molecules. The azo dye molecules can contain water-solubilising groups, e.g. acid amide, alkylsulfonyl, or the above mentioned acid groups. Preferred metal complex dyes are 1:2 cobalt or 1:2 chromium complex dyes of monoazo dyes which contain acid amide or alkylsulfonyl groups or altogether a single sulfonic acid group. Mixtures of anionic dyes may also be used.

Blends of polyester and cotton are normally dyed with combinations of disperse dyes and vat dyes, sulfur dyes, leuco vat ester dyes, direct dyes or reactive dyes, and the polyester constituent is dyed beforehand, simultaneously or subsequently with disperse dyes. The vat dyes are higher fused and heterocyclic benzoquinones or naphthoquinones, sulfur dyes and, in particular, anthraquinoid or indigoid dyes. Examples of vat dyes which may be employed in the process of this invention are listed in the Colour Index, 3rd Edition (1971), Vol. 3, pp. 3649–3837 under the heading "Sulphur Dyes" and "Vat Dyes". Suitable direct dyes are e.g. those listed under the heading "Direct Dyes", C.I. (1971), 3rd Ed., Vol. 2, pp. 2005–2478. The leuco vat ester dyes are obtainable e.g. from vat dyes of the indigo, anthraquinone or indanthrene series by reduction e.g. with iron powder and subsequent esterification e.g. with chlorosulfonic acid, and are listed under the heading "Solubilised Vat Dyes", C.I. (1971), 3rd Ed., Vol. 3. Reactive dyes will be understood as meaning the customary dyes which form a covalent bond with cellulose, e.g. those listed under the heading "Reactive Dyes" in C.I. (1971), 3rd Ed., Vol. 3., pp. 3391–3560.

The novel assistant compositions may also be used in the whitening of undyed synthetic fibre materials with fluorescent whitening agents which are dispersed in water.

The fluorescent whitening agents may belong to any class of such compounds. In particular they are coumarins, triazole coumarins, benzocoumarins, oxazines, pyrazines, pyrazolines, diphenyl pyrazolines, stilbenes, styryl stilbenes, triazolyl stilbenes, bisbenzoxazolyl ethylenes, stilbene bis-benzoxazoles, phenylstilbene oxazoles, thiophene bis-benzoxazoles, naphthalene bis-benzoxazoles, benzofuranes, benzimidazoles and naphthalimides.

Mixtures of fluorescent whitening agents may also be used in the practice of this invention.

The amount of dye or fluorescent whitening agent to be added to the liquor depends on the desired colour strength. In general, amounts of 0.01 to 10% by weight, preferably 0.02 to 5% by weight, based on the weight of the textile material employed, have proved advantageous.

The compositions to be employed in the practice of this invention may also be used in admixture with known carriers based on e.g. di- or trichlorobenzene, methyl or ethyl benzene, o-phenylphenol, benzylphenol, diphenyl ether, chlorodiphenyl, methyl diphenyl, cyclohexanone, acetophenone, alkylphenoxy ethanol, mono-, di- or trichlorophenoxy ethanol or mono-, di- or tri-chlorophenoxy propanol, pentachlorophenoxy ethanol, alkylphenylbenzoates or, in particular, based on diphenyl, methyl diphenyl ether, dibenzyl ether, methyl benzoate, butyl benzoate or phenyl benzoate.

The carriers are used preferably in an amount of 0.5 g/l to 2 g/l of liquor or 5 to 30% by weight, based on the composition.

Depending on the textile material to be treated, the dyebaths or whitening baths may contain, in addition to the dyes or fluorescent whitening agents and compositions of the invention, also wool protecting agents, oligomer inhibitors, antifoams, emulsifiers, levelling agents, retarders and, preferably, dispersants.

The purpose of the dispersants is in particular to obtain a good dispersion of the disperse dyes. Suitable dispersants are those customarily employed in dyeing with disperse dyes. Preferred dispersants are sulfated or phosphated adducts of 15 to 100 moles of ethylene oxide or preferably propylene oxide with polyhydric aliphatic alcohols containing 2 to 6 carbon atoms, e.g. ethylene glycol, glycerol or pentaerythritol, or with amines containing 2 to 9 carbon atoms and at least two amino groups or one amino group and one hydroxyl group, as well as alkylsulfonates containing 10 to 20 carbon atoms in the alkyl chain, alkylbenzenesulfonates with straight or branched alkyl chain containing 8 to 20 carbon atoms, e.g. nonyl- or dodecylbenzenesulfonate, 1,3,5,7-tetramethyloctylbenzenesulfonate or octadecylbenzenesulfonate, and alkylnaphthalenesulfonates or sulfosuccinates, such as sodium dioctylsulfosuccinate.

Particularly suitable anionic dispersants are lignosulfonates, polyphosphates and, preferably, formaldehyde condensation products of aromatic sulfonic acids, formaldehyde and, optionally, of mono- or bifunctional phenols, e.g. of cresol, β-naphtholsulfonic acid and formaldehyde, of benzenesulfonic acid, formaldehyde and naphthalenesulfonic acid, of naphthalenesulfonic acid and formaldehyde, or of naphthalenesulfonic acid, dihydroxydiphenylsulfone and formaldehyde. The preferred anionic dispersant is the disodium salt of di-(6-sulfonaphthyl-2)-methane.

Mixtures of anionic dispersants may also be employed. Normally the anionic dispersants will be in the form of their alkali metal salts, ammonium salts or amine salts. These dispersants are preferably employed in an amount of 0.1 to 5 g/l of treatment liquor.

Depending on the dye and substrate to be employed, the dyebaths or whitening baths may also contain in addition to the compositions of the invention, conventional additives, advantageously electrolytes such as salts, e.g. sodium sulfate, ammonium sulfate, sodium or ammonium phosphates or sodium or ammonium polyphosphates, metal chlorides or metal nitrates such as calcium chloride, magnesium chloride or calcium nitrates, ammonium acetate or sodium acetate and/or acids, e.g. mineral acids, such as sulfuric acid or phosphoric acid, or organic acids, preferably lower aliphatic carboxylic acids, such as formic acid, acetic acid or oxalic acid. The acids are used in particular for adjusting the pH value of the dyebaths employed in the invention. The pH value is ordinarily in the range from 4 to 6.5, preferably from 4.5 to 6.

Dyeing or whitening is performed advantageously from an aqueous liquor by the exhaust method. The liquor ratio can accordingly be chosen within a wide range, e.g. from 1:4 to 1:100, preferably from 1:6 to 1:50. The dyeing or whitening temperature is at least 70° C. and is ordinarily not higher than 140° C. Preferably it is in the range from 80° to 135° C.

Linear polyester fibres and cellulose triacetate fibres are preferably dyed by the high temperature process in closed and advantageously also pressure-resistant machines at temperatures above 100° C., preferably in the range between 110° and 135° C., and optionally under pressure. Examples of suitable closed dyeing machines are circulating liquor machines such as cheese dyeing and beam dyeing machines, winch becks, jet dyeing or rotary dyeing machines, muff dyeing machines, paddles or jiggers. Cellulose 2½-acetate fibers are preferably dyed at temperatures from 80° to 85° C.

The dyeing process of the present invention can be carried out such that the material to be dyed is either briefly treated first with the dyeing assistant and then dyed, or preferably simultaneously with the assistant and the dye. The goods are preferably run for 5 minutes at 60°–80° C. in the bath which contains the dye, the composition and optionally further ingredients, and which is adjusted to a pH value of 4.5 to 5.5, then the temperature is raised over 15 to 35 minutes to 110°–135° C., preferably to 130° C., and the bath is left for 15 to 90 minutes, preferably for 30 minutes, at this temperature.

The dyeings are finished by cooling the dyebath to 60°–80° C., rinsing them with water and, if desired, effecting a reductive afterclear in alkaline medium in conventional manner. The dyeings are then once more rinsed and dried. When using carriers, the dyeings are conveniently subjected to a heat treatment, e.g. a thermosol treatment, in order to improve the lightfastness. This heat treatment is preferably carried out in the temperature range from 160° to 180° C. over 30 to 90 seconds. When using vat dyes for the cellulose constituent, the goods are first treated with hydrosulfite at a pH of 6 to 12.5 and then with an oxidising agent, and finally given a washing off.

The process of the invention gives level and intense dyeings which are distinguished by good dye yields. In particular, level dyeings are obtained, and the material has a crease-resistant rating of 2–5 according to the Monsanto standard and has a level appearance and an attractive soft handle. In addition, the fastness properties of the dyeings, e.g. lightfastness, crockfastness and wetfastness, are not impaired by the use of the composition of the invention. Further, no troublesome foaming occurs during dyeing in the presence of the composition of the invention.

In the following Preparatory and Application Examples, parts and percentages are by weight, unless otherwise indicated. The indicated amounts of dye refer to commercially available, i.e. diluted, product, and the indicated amounts of the components of the composition refer to pure substance. Five-figure Colour Index (C.I.) numbers refer to the 3rd Edition of the Colour Index.

PREPARATORY EXAMPLES

Example A 150 g of polyethylene glycol having an average molecular weight of 1500, 19.6 g of maleic anhydride and 0.3 g of di-(tert-butyl)-p-cresol are heated to 130° C. and the mixture is stirred for 3 hours at 130° C. The reflux cooler is replaced by a distillation receiver and then 60 g of a condensation product of 1 mole of pentaerythritol and 8 moles of propylene oxide, 22 g of stearic acid and 0.5 g of 99% sulfuric acid are added, and the mixture is kept for 5 hours under vacuum at 130° C.. while small amounts of water are distilled off. The melt is cooled to about 60° C. and 2 g of 30% sodium hydroxide solution are added to neutralise the sulfuric acid. An ester condensation product having an acid number of 7 is obtained. This condensate is dissolved in 580 g of water and the solution is adjusted to pH 6.5–7 by addition of 30% sodium hydroxide solution. A 30% viscous solution of the polypropylene oxide adduct is obtained.

Example B

The procedure of Example A is repeated, but using 10.6 g of diethylene glycol instead of 150 g of polyethylene glycol, and 15.6 g of coconut fatty acid instead of 22 g of stearic acid. A 30% viscous emulsion of the carboxylated polypropylene oxide adduct is obtained.

Example C

The procedure of Example A is repeated, but using 20 g of succinic anhydride instead of 19.6 g of maleic anhydride, and 15.6 g of coconut fatty acid instead of 22 g of stearic acid. A 30% viscous solution of the polypropylene oxide adduct is obtained.

Example D

The procedure of Example A is repeated, but using 100 g of polyethylene glycol having an average molecular weight of 1000 instead of 150 g of polyethylene glycol 1500. A 30% viscous solution of the polypropylene oxide adduct is obtained.

Example E

The procedure of Example A is repeated, but using 21.8 g of oelic acid instead of 22 g of stearic acid. A 30% viscous solution of the polypropylene oxide adduct is obtained.

Example F

2 $cm^3$ of a 30% methanolic potassium hydroxide solution are added dropwise at room temperatures over 20 minutes to 144.3 g of 3,5,5-trimethylhexyl alcohol and 53.5 g of acrylonitrile, while keeping the temperature below 40° C. with periodic cooling. The reaction mixture is stirred for 3 hours at 40° C., then a further 1 $cm^3$ of 30% methanolic potassium hydroxide solution is added. The reaction mixture is kept for a further 2 hours at 40° C., and then cooled to 25° C. The reaction product is then neutralised with acetic acid and kept for 60 minutes at 50° C. under vacuum. Yield: 198 g of an adduct of the formula $$(CH_3)_3C-CH_2-\underset{\underset{CH_3}{|}}{CH}-CH_2CH_2-O-CH_2CH_2CN \quad (14)$$

in the form of a clear, colourless liquid.

The cyanoethylated compounds of the formulae (3) to (13) and (15) to (25) are also prepared in this manner.

APPLICATION EXAMPLES

Example 1

100 g of texturised polyester knitted fabric are dyed in 2.4 liters of water on a laboratory jet dyeing machine with the following ingredients:

2 g of a dye of the formula

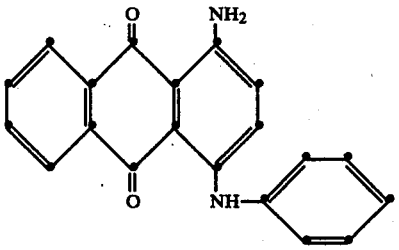

(101)

5 g of ammonium sulfate 2 g of a mixture of a polyglycol oleate and a polyadduct of 9 moles of ethylene oxide and 1 mole of p-tert-octylphenol 0.2 g of 85% formic acid and 6 g of a composition (1) consisting of 30% of a compound of the formula $$(CH_3)_3C-CH_2-\underset{\underset{CH_3}{|}}{CH}-CH_2CH_2-O-CH_2CH_2CN \quad (14)$$

30% of the product prepared in Example A (30%)

2% of a siloxane-oxyalkylene copolymer ($C_1$) having a viscosity of 1200 mPas at 20° C. and a cloud point of 32° C., and 38% of water.

The above ingredients are first dissolved or dispersed in water and added to the dyebath at 70° C. The dyeing temperature is then raised over 60 minutes to 127° C. and the goods are dyed for a further 60 minutes at this temperature. The bath is then cooled to 20° C. over 4 minutes and the goods are then rinsed and dried. A level blue dyeing is obtained.

The dyed goods have a rating of 3 according to the Monsanto standard (test of crease resistance). The rating is only 1 without the addition of composition (1).

Example 2

100 kg of a polyester/wool (55:45) blended fabric are treated on a winch beck with a dye liquor which contains 1 kg of a mixture (7:3) of the dyes of the formulae

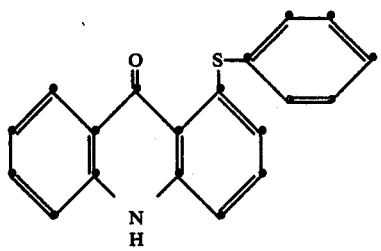

(102)

and

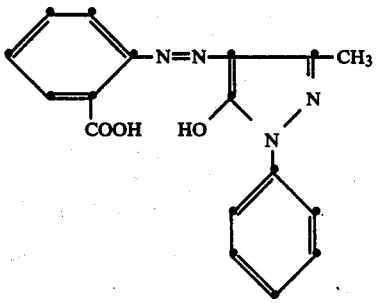

(103)

0.8 kg of the sodium salt of ethylenediaminetetraacetic acid 4 kg of the reaction product of naphthalenesulfonic acid and formaldehyde 2 kg of an amphoteric fatty amine polyglycol ether sulfate and 3 kg of composition (1)

in 4000 liters of water. The temperature is then raised to 107° C. over 30 minutes and the goods are dyed for 1 hour at this temperature. The bath is then cooled to 20° C. and the fabric is then rinsed and dried. A level, fast, yellow dyeing is obtained. Compared with a dyeing obtained on a fabric without the addition of composition (1), a 30% greater dye yield is obtained on the polyester constituent of the fabric dyed according to this Example. The dyebath does not foam during the entire duration of the dyeing procedure.

According to the Monsanto standard, the dyed goods are rated 2–3.

Example 3

A high temperature dyeing machine which contains 100 kg of polyester/cellulose (67:33) fabric in 3000 liters of water of 60° C., is initially charged with the following ingredients:

2 kg of a mixture of the dyes of the formula

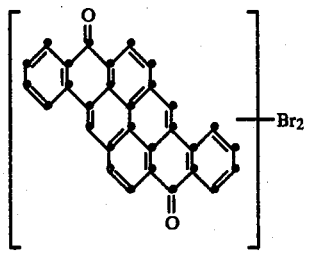

(104)

and

-continued

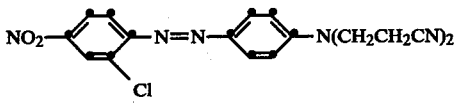

(105)

6 kg of ammonium sulfate and
0.6 kg of a fatty alkylbenzimidazole sulfonate.
Then 4 kg of composition (1) are added. The pH of the dyebath is adjusted to 5 with 85% formic acid and the goods are allowed to circulate for 15 minutes. The temperature is then raised to 125° C. over 50 minutes and the goods are treated for 90 minutes at this temperature. The bath is then cooled to 70° C. and the following further ingredients are added in order to develop the vat dye:
9 kg of 30% sodium hydroxide solution
9 kg of 40% hydrosulfite and
5 kg of sodium chloride.
The goods are subsequently treated for 45 minutes at 70° C., then rinsed, oxidised with hydrogen peroxide, rinsed again, and dried. A level, fast, orange dyeing is obtained.

A comparison with a dyeing obtained without the addition of composition (1) shows that a 20% greater dye yield is obtained on the polyester constituent of the fabric dyed in accordance with this Example. The dyebath does not foam during the entire duration of the dyeing procedure. According to the Monsanto standard, the rating is 3–4.

Example 4

100 kg of the polyester fabric are wetted at 60° C. in 800 ml of water in a jet dyeing machine. The following ingredients are then added:
2200 g of a dye of the formula

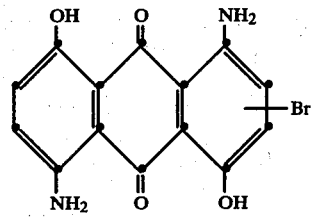

(106)

2000 g of an ammonium salt of the formula

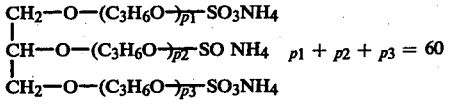

(107)

1600 g of ammonium sulfate and
3000 g of a composition (2) consisting of
30% of a compound of the formula

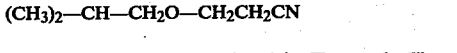

(5)

30% of the product obtained in Example E
20% of propylene carbonate and
20% of water.
The dyebath is then adjusted to pH 5.5 with formic acid and heated to 125° C. over 45 minutes and the goods are then dyed for 60 minutes at this temperature. The bath is then cooled and the goods are rinsed and dried. A level, crockfast, blue dyeing is obtained. According to the Monsanto standard, the dyed goods have a rating of 3.5. Without the addition of composition (2) the rating is only 1.

A level, crockfast, blue dyeing is also obtained by using, in this Example, the same amount of the following compositions (3) or (4) instead of composition (2):
(3) Composition consisting of
25% of a compound of the formula (23)

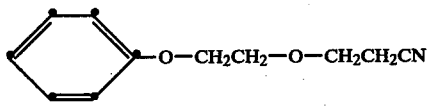

40% of the product prepared according to Example C
1% of a siloxane-oxyalkylene copolymer ($C_1$) having a viscosity of 1200 mPas at 20° C. and a cloud point of 32° C.,
5% of isobutanol and
29% of water.
(4) Composition consisting of
20% of a compound of the formula (11)

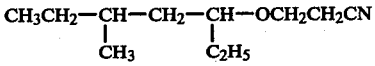

45% of the product prepared according to Example B
20% of isobutanol and
15% of water.

Example 5

10 g of polyethylene glycol terephthalate fabric are treated for 5 minutes at 40° C. in a dyeing apparatus with a liquor which contains
0.2 g of composition (1) and
0.01 g of a dispersion of a fluorescent whitening agent of the formula

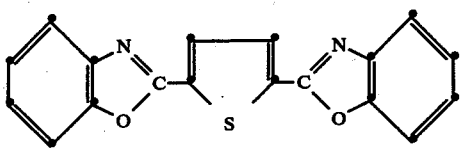

(108)

in 200 ml of water and which has been adjusted to pH 5.5 with 85% formic acid. The liquor is then heated over 30 minutes to 110° C. and the goods are dyed for 30 minutes at this temperature. The liquor is then cooled to 40° C. over 15 minutes and the goods are subsequently rinsed and dried at 70° C. A brilliant, level white effect with an excellent degree of whiteness is obtained.

Example 6

The procedure of Example 5 is repeated, but using a liquor which, instead of the fluorescent whitening agent of the formula (108), contains the same amount of a fluorescent whitening agent of the formula

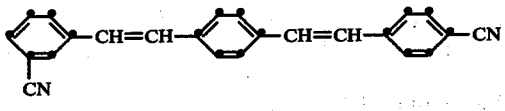

(109)

-continued or

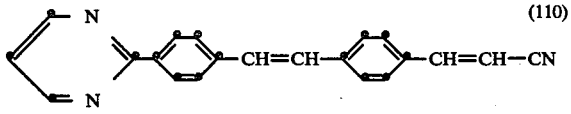

(110)

Level, brilliant white effects are also obtained.

What is claimed is:

1. A non-foaming anticrease finishing composition for dyeing or whitening textile material which contains polyester fibres, which composition comprises at least (A) an O-cyanoethylated compound of the formula $$R(O—CH_2CH_2CN)_n, \quad (1)$$

wherein R is an n-valent aliphatic, cycloaliphatic or araliphatic radical, and n is 1 to 5, and (B) a carboxylated polypropylene oxide adduct, or salt thereof, which adduct is obtained from (a) 1 to 3 moles of an aliphatic diol having an average molecular weight of at most 2600, (b) 2 to 4 moles of an aliphatic dicarboxylic acid, or anhydride thereof, containing 4 to 10 carbon atoms, (c) 1 mole of an adduct of propylene oxide and an at least trihydric aliphatic alcohol containing 3 to 10 carbon atoms, and (d) 0.5 to 2 moles of a fatty acid containing 8 to 22 carbon atoms.

2. A composition according to claim 1 which comprises, as additional component (C), an aliphatic alcohol containing 5 to 18 carbon atoms, a siloxane-oxyalkylene copolymer, or a mixture thereof.

3. A composition according to claim 2, wherein component (C) is a polyether siloxane having a cloud point in the range from 20° to 70° C.

4. A composition according to claim 1, which comprises additionally, as component (D), a polar solvent.

5. A composition according to claim 4, wherein component (D) is water.

6. A composition according to claim 1, which comprises additionally as component (C) an aliphatic alcohol containing 5 to 18 carbon atoms, a siloxane-oxyalkylene copolymer, or a mixture thereof and as component (D), a polar solvent.

7. A composition according to claim 1, wherein component (A) is an O-cyanoethylated compound of the formula $$R_1—O—CH_2CH_2CN \quad (2)$$

wherein $R_1$ is an aliphatic radical of 3 to 22 carbon atoms or a phenoxyethyl radical which is unsubstituted or substituted by halogen, lower alkyl or lower alkoxy.

8. A composition according to claim 7, wherein $R_1$ in formula (2) is alkyl of 3 to 22 carbon atoms.

9. A composition according to claim 1, wherein component (B) is obtained from ($a_1$) an aliphatic diol of the formula $$HO\text{-}(CH_2CH_2O)_{m_1}H, \quad (27)$$

wherein $m_1$ is 10 to 40, ($b_1$) a saturated or ethylenically unsaturated aliphatic dicarboxylic acid, or anhydride thereof, containing 4 to 10 carbon atoms, ($c_1$) an adduct of propylene oxide and a trihydric to hexahydric alkanol containing 3 to 6 carbon atoms, and ($d_1$) a saturated or unsaturated fatty acid containing 12 to 22 carbon atoms.

10. A composition according to claim 9, wherein component (B) is obtained from 1 mole of the adduct of 1 mole of pentaerythritol and 4 to 8 moles of propylene oxide; 2 moles of maleic anhydride; 1 mole of polyethylene glycol having an average molecular weight of 1500; and 0.8 mole of stearic acid.

11. A composition according to claim 1, which comprises at least (Aa) an O-cyanoethylated compound of the formula $$R_2—O—CH_2CH_2CN, \quad (28)$$

wherein $R_2$ is an aliphatic radical of 6 to 22 carbon atoms or a phenoxyethyl radical which is unsubstituted or substituted by halogen, methyl or methoxy, and (Bb) a carboxylated polypropylene oxide adduct, or salt thereof, which adduct has been obtained from components ($a_1$), ($b_1$), ($c_1$) and ($d_1$) as defined in claim 8.

12. A composition according to claim 1, which comprises 10 to 60% by weight of component (A)
20 to 50% by weight of component (B)
0 to 15% by weight of component (C), and
0 to 60% by weight of component (D), based on the entire composition.

13. A composition according to claim 12, wherein component (C) is present in an amount of 1 to 10% by weight, based on the entire composition.

14. A composition according to claim 12, wherein component (D) is present in an amount of 10 to 45% by weight, based on the entire composition.

15. A process for dyeing textile material which contains polyester fibers with disperse dyes, or for treating such material with fluorescent whitening agents, which process comprises dyeing or whitening said material in the presence of a composition which contains at least (A) an O-cyanoethylated compound of the formula $$R(O—CH_2CH_2CN)_n, \quad (1)$$

wherein R is an n-valent aliphatic, cycloaliphatic or araliphatic radical, and n is 1 to 5, and (B) a carboxylated polypropylene oxide adduct, or salt thereof, which adduct is obtainable from (a) an aliphatic diol having an average molecular weight of at most 2600, (b) an aliphatic dicarboxylic acid, or anhydride thereof, containing 4 to 10 carbon atoms, (c) an adduct of propylene oxide and an at least trihydric aliphatic alcohol containing 3 to 10 carbon atoms, and (d) a fatty acid containing 8 to 22 carbon atoms.

16. A process according to claim 15, wherein the composition additionally contains, as component (C), an aliphatic alcohol of 5 to 18 carbon atoms, a siloxane-oxyalkylene copolymer, or a mixture thereof, and, as component (D), a polar solvent.

17. A process according to claim 15, wherein the composition is employed in an amount of 0.5 to 10% by weight, based on the weight of the material to be dyed.

18. A process according to claim 15, wherein dyeing or treatment with fluorescent whitening agents is carried out in the temperature range from 80° to 135° C.

19. A process according to claim 18, wherein the temperature range is from 110° to 135° C.

* * * * *